US011495176B1

(12) United States Patent
Hsieh et al.

(10) Patent No.: US 11,495,176 B1
(45) Date of Patent: Nov. 8, 2022

(54) METHODS AND CONFIGURATIONS FOR IMPROVING THE PERFORMANCE OF SENSORS UNDER A DISPLAY

(71) Applicant: Apple Inc., Cupertino, CA (US)

(72) Inventors: Cheng-Chih Hsieh, Santa Clara, CA (US); Abbas Jamshidi Roudbari, Saratoga, CA (US); Shih Chang Chang, Cupertino, CA (US); Shyuan Yang, Burlingame, CA (US); Ting-Kuo Chang, San Jose, CA (US); Tsung-Ting Tsai, San Jose, CA (US); Warren S. Rieutort-Louis, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/203,356

(22) Filed: Mar. 16, 2021

Related U.S. Application Data

(60) Provisional application No. 63/028,065, filed on May 21, 2020.

(51) Int. Cl.
*G09G 3/3266* (2016.01)
*G09G 3/3233* (2016.01)

(52) U.S. Cl.
CPC ..... *G09G 3/3233* (2013.01); *G09G 3/3266* (2013.01); *G09G 2310/0243* (2013.01); *G09G 2320/0233* (2013.01); *G09G 2320/064* (2013.01); *G09G 2360/14* (2013.01)

(58) Field of Classification Search
CPC ..... G09G 2330/028; G09G 2310/0286; G09G 2310/0264; G09G 2310/08; G09G 2360/14; G09G 2320/064; G09G 2310/0243; G09G 3/3266
See application file for complete search history.

(56) References Cited

U.S. PATENT DOCUMENTS

| | | | |
|---|---|---|---|
| 8,599,116 | B2 | 12/2013 | Mitsuhashi |
| 8,964,298 | B2 | 2/2015 | Haddick et al. |
| 9,024,530 | B2 | 5/2015 | Land et al. |
| 9,871,587 | B2 | 1/2018 | Aoyama et al. |
| 10,088,958 | B2 | 10/2018 | Park et al. |
| 10,872,922 | B2 | 12/2020 | Jia et al. |
| 2009/0278789 | A1 | 11/2009 | Declercq et al. |
| 2010/0238150 | A1 | 9/2010 | Matsuki et al. |

(Continued)

*Primary Examiner* — Dennis P Joseph
(74) *Attorney, Agent, or Firm* — Treyz Law Group, P.C.; Jason Tsai

(57) ABSTRACT

An electronic device may include a display and a sensor under the display. The display may include pixels having emission transistors that are controlled by emission signals. The emission signals are controlled using a pulse width modulation (PWM) scheme to control the brightness of the display. The emission signals may further include a localized sensor blackout pulse configured to generate a localized sensor blackout region that overlaps with the sensor to reduce any undesired back emission of light emitted from the display. The sensor blackout pulse may be automatically generated periodically or generated in an on-demand basis once per frame, multiple times per frame time, or once every multiple frames. Any luminance degradation caused by the sensor blackout pulse may be compensated by boosting the luminance and/or by extending the duration of each emission on pulse.

19 Claims, 14 Drawing Sheets

(56) References Cited

U.S. PATENT DOCUMENTS

| | | | | |
|---|---|---|---|---|
| 2018/0196931 | A1* | 7/2018 | Cho | G06F 21/32 |
| 2020/0005706 | A1* | 1/2020 | Li | G06K 9/0004 |
| 2020/0117782 | A1* | 4/2020 | Lee | G09G 3/3406 |
| 2020/0380919 | A1 | 12/2020 | Hwang et al. | |
| 2020/0402478 | A1* | 12/2020 | Her | G09G 3/3233 |
| 2021/0056896 | A1 | 2/2021 | Greimel-Längauer et al. | |
| 2021/0407351 | A1* | 12/2021 | Huang | G09G 3/035 |

* cited by examiner

METHODS AND CONFIGURATIONS FOR IMPROVING THE PERFORMANCE OF SENSORS UNDER A DISPLAY

This application claims the benefit of U.S. provisional patent application No. 63/028,065, filed May 21, 2020, which is hereby incorporated by reference herein in its entirety.

BACKGROUND

This relates generally to electronic devices, and, more particularly, to electronic devices with displays.

Electronic devices often include displays. For example, an electronic device may have an organic light-emitting diode (OLED) display based on organic light-emitting diode pixels. In this type of display, each pixel includes a light-emitting diode and thin-film transistors for controlling application of a signal to the light-emitting diode to produce light. The light-emitting diodes may include OLED layers positioned between an anode and a cathode.

There is a trend towards borderless electronic devices with a full-face display. These devices, however, may still need to include sensors such as cameras, ambient light sensors, and proximity sensors to provide other device capabilities. Since the display now covers the entire front face of the electronic device, the sensors will have to be placed under the display stack. In practice, some of the light emitted from the display pixels and traversing through the display stack can be reflected back towards the sensors and degrade sensor performance.

It is within this context that the embodiments herein arise.

SUMMARY

An electronic device may include a display and a sensor that is formed underneath the display and that is configured to receive light through the display. The display may include pixels each having a light-emitting diode coupled in series with at least one emission transistor. The emission transistors may be controlled by emission signals, which can be controlled using a pulse width modulation (PWM) scheme to adjust the brightness of the display.

The display may be provided with a localized sensor blackout region that overlaps with the sensor. Pixels in the localized sensor blackout region are prevented from emitting light while the sensor is detecting light through the display. The localized sensor black region may remain at a static location on the display. Emission signals provided to pixels outside the localized sensor blackout region may include PWM blanking pulses, whereas emission signals provided to pixels within the localized sensor blackout region may include PWM blanking pulses and sensor blackout pulses for producing the localized sensor blackout region. The sensor blackout pulses may be generated on a periodic basis or in an on-demand basis once per frame, multiple times per frame, or once every few frames. The pulse width of the sensor blackout pulses may be statically or dynamically adjusted to control the size of the localized sensor blackout region.

The emission signals may be generated using emission gate drivers. The emission gate drivers may all be connected in a chain and may be controlled using one start pulse signal. Alternatively, the emission gate drivers need not all be connected in a chain and may be controlled using two or more separate start pulse signals. The emission gate drivers outputting the emission signals to the localized sensor blackout region may further receive an enable signal for asserting a sensor blackout pulse and a reset signal for deasserting the sensor blackout pulse.

The display may also include a pixel luminance uniformity compensation circuit configured to compensate for a luminance reduction for pixel rows within the localized sensor blackout region due to the sensor blackout pulses. The luminance uniformity compensation circuit may be configured to compensate for the luminance reduction by selectively boosting the luminance level during emission on times and/or by extending emission on times for the pixels in the localized sensor blackout region.

DETAILED DESCRIPTION

Figure 1:
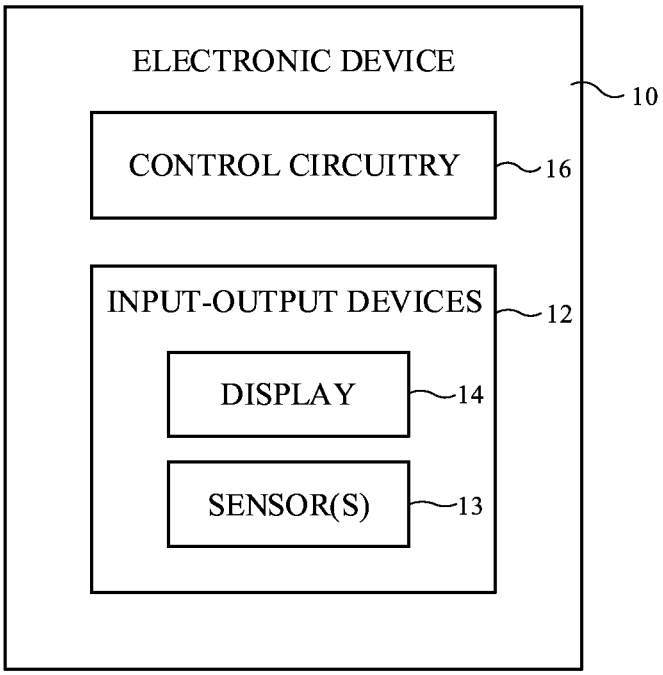
FIG. 1 is a schematic diagram of an illustrative electronic device having a display and one or more sensors in accordance with an embodiment.

An illustrative electronic device of the type that may be provided with a display is shown in FIG. 1. Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a display, a computer display that contains an embedded computer, a computer display that does not contain an embedded computer, a gaming device, a navigation device, an embedded system such as a system in which electronic equipment with a display is mounted in a kiosk or automobile, or other electronic equipment. Electronic device 10 may optionally have the shape of a pair of eyeglasses (e.g., supporting frames), may form a housing having a helmet shape, or may have other configurations to help in mounting and securing the components of one or more displays on the head or near the eye of a user.

As shown in FIG. 1, electronic device 10 may include control circuitry 16 for supporting the operation of device 10. Control circuitry 16 may include storage such as hard disk drive storage, nonvolatile memory (e.g., flash memory or other electrically-programmable-read-only memory configured to form a solid-state drive), volatile memory (e.g., static or dynamic random-access memory), etc. Processing circuitry in control circuitry 16 may be used to control the operation of device 10. The processing circuitry may be based on one or more microprocessors, microcontrollers, digital signal processors, baseband processors, power management units, audio chips, application-specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input resources of input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements. A touch sensor for display 14 may be formed from electrodes formed on a common display substrate with the display pixels of display 14 or may be formed from a separate touch sensor panel that overlaps the pixels of display 14. If desired, display 14 may be insensitive to touch (i.e., the touch sensor may be omitted). Display 14 in electronic device 10 may be a head-up display that can be viewed without requiring users to look away from a typical viewpoint or may be a head-mounted display that is incorporated into a device that is worn on a user's head. If desired, display 14 may also be a holographic display used to display holograms.

Control circuitry 16 may be used to run software on device 10 such as operating system code and applications. During operation of device 10, the software running on control circuitry 16 may display images on display 14.

Input-output devices 12 may also include one or more sensors 13 such as force sensors (e.g., strain gauges, capacitive force sensors, resistive force sensors, etc.), audio sensors such as microphones, touch and/or proximity sensors such as capacitive sensors (e.g., a two-dimensional capacitive touch sensor associated with a display and/or a touch sensor that forms a button, trackpad, or other input device not associated with a display), and other sensors. In accordance with some embodiments, sensors 13 may include optical sensors such as optical sensors that emit and detect light (e.g., optical proximity sensors such as transreflective optical proximity structures), ultrasonic sensors, and/or other touch and/or proximity sensors, monochromatic and color ambient light sensors, image sensors, fingerprint sensors, temperature sensors, proximity sensors and other sensors for measuring three-dimensional non-contact gestures ("air gestures"), pressure sensors, sensors for detecting position, orientation, and/or motion (e.g., accelerometers, magnetic sensors such as compass sensors, gyroscopes, and/or inertial measurement units that contain some or all of these sensors), health sensors, radio-frequency sensors, depth sensors (e.g., structured light sensors and/or depth sensors based on stereo imaging devices), optical sensors such as self-mixing sensors and light detection and ranging (lidar) sensors that gather time-of-flight measurements, humidity sensors, moisture sensors, gaze tracking sensors, and/or other sensors. In some arrangements, device 10 may use sensors 13 and/or other input-output devices to gather user input (e.g., buttons may be used to gather button press input, touch sensors overlapping displays can be used for gathering user touch screen input, touch pads may be used in gathering touch input, microphones may be used for gathering audio input, accelerometers may be used in monitoring when a finger contacts an input surface and may therefore be used to gather finger press input, etc.).

Display 14 may be an organic light-emitting diode display or may be a display based on other types of display technology. Device configurations in which display 14 is an organic light-emitting diode display are sometimes described herein as an example. This is, however, merely illustrative. Any suitable type of display may be used, if desired. In general, display 14 may have a rectangular shape (i.e., display 14 may have a rectangular footprint and a rectangular peripheral edge that runs around the rectangular footprint) or may have other suitable shapes. Display 14 may be planar or may have a curved profile.

Figure 2A:
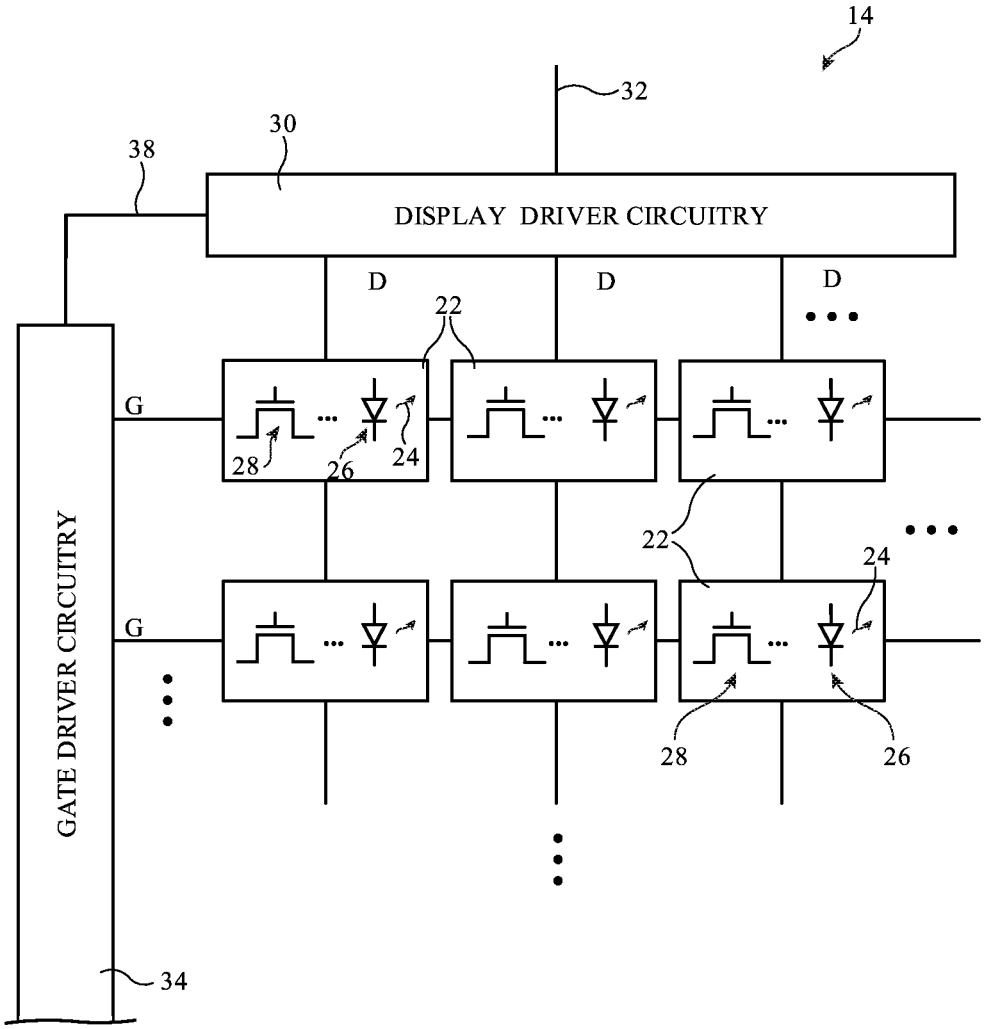
FIG. 2A is a schematic diagram of an illustrative display with light-emitting elements in accordance with an embodiment.

A top view of a portion of display 14 is shown in FIG. 2A. As shown in FIG. 2A, display 14 may have an array of pixels 22 formed on a substrate. Pixels 22 may receive data signals over signal paths such as data lines D and may receive one or more control signals over control signal paths such as horizontal control lines G (sometimes referred to as gate lines, scan lines, emission control lines, etc.). There may be any suitable number of rows and columns of pixels 22 in display 14 (e.g., tens or more, hundreds or more, or thousands or more). Each pixel 22 may include a light-emitting diode 26 that emits light 24 under the control of a pixel control circuit formed from thin-film transistor circuitry such as thin-film transistors 28 and thin-film capacitors. Thin-film transistors 28 may be polysilicon thin-film transistors, semiconducting-oxide thin-film transistors such as indium zinc gallium oxide (IGZO) transistors, or thin-film transistors formed from other semiconductors. Pixels 22 may contain light-emitting diodes of different colors (e.g., red, green, and blue) to provide display 14 with the ability to display color images or may be monochromatic pixels.

Display driver circuitry may be used to control the operation of pixels 22. The display driver circuitry may be formed from integrated circuits, thin-film transistor circuits, or other suitable circuitry. Display driver circuitry 30 of FIG. 2A may contain communications circuitry for communicating with system control circuitry such as control circuitry 16 of FIG. 1 over path 32. Path 32 may be formed from traces on a flexible printed circuit or other cable. During operation, the control circuitry (e.g., control circuitry 16 of FIG. 1) may supply display driver circuitry 30 with information on images to be displayed on display 14.

To display the images on display pixels 22, display driver circuitry 30 may supply image data to data lines D while issuing clock signals and other control signals to supporting display driver circuitry such as gate driver circuitry 34 over path 38. If desired, display driver circuitry 30 may also supply clock signals and other control signals to gate driver circuitry 34 on an opposing edge of display 14.

Gate driver circuitry 34 (sometimes referred to as row control circuitry) may be implemented as part of an integrated circuit and/or may be implemented using thin-film transistor circuitry. Horizontal control lines G in display 14 may carry gate line signals such as scan line signals, emission enable control signals, and other horizontal control signals for controlling the display pixels 22 of each row. There may be any suitable number of horizontal control signals per row of pixels 22 (e.g., one or more row control signals, two or more row control signals, three or more row control signals, four or more row control signals, etc.).

The region on display 14 where the display pixels 22 are formed may sometimes be referred to herein as the active area. Electronic device 10 has an external housing with a peripheral edge. The region surrounding the active and within the peripheral edge of device 10 is the border region. Images can only be displayed to a user of the device in the active region. It is generally desirable to minimize the border region of device 10. For example, device 10 may be provided with a full-face display 14 that extends across the entire front face of the device. If desired, display 14 may also wrap around over the edge of the front face so that at least part of the lateral edges or at least part of the back surface of device 10 is used for display purposes.

Figure 2B:
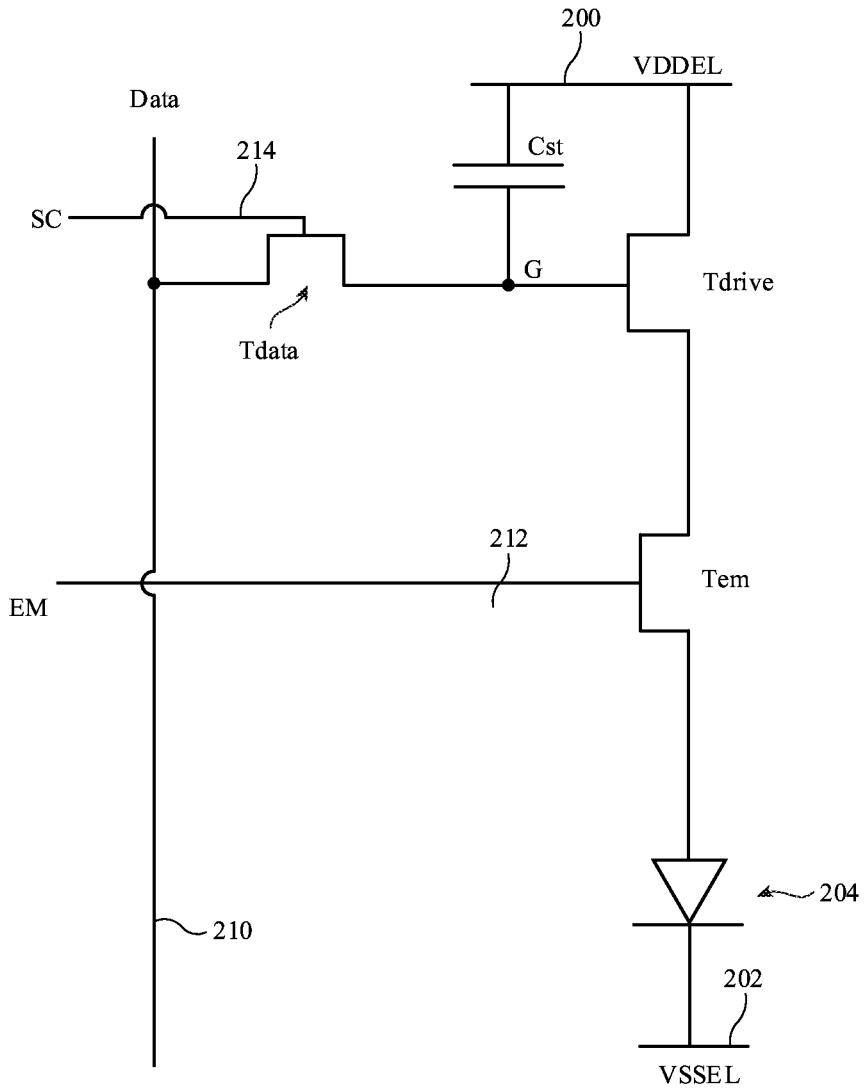
FIG. 2B is a circuit diagram of an illustrative display pixel in accordance with an embodiment.

FIG. 2B is a circuit diagram of an illustrative organic light-emitting diode display pixel 22 in display 14. As shown in FIG. 2B, display pixel 22 may include an organic light-emitting diode 204, a storage capacitor Cst and associated pixel transistors such as a drive transistor Tdrive, a data loading transistor Tdata, and an emission transistor Tem. Any number of these transistors may be implemented as a semiconducting-oxide transistor (e.g., a transistor with an n-type channel formed from semiconducting oxide such as indium gallium zinc oxide or IGZO) or as a silicon transistor (e.g., a transistor with a polysilicon channel deposited using a low temperature process, sometimes referred to as "LTPS" or low-temperature polysilicon transistor). Semiconducting-oxide transistors exhibit relatively lower leakage than silicon transistors.

In the example of FIG. 2B, the drive transistor Tdrive, emission transistor Tem, and diode 204 may be coupled in series between power supply terminals 200 and 202. A positive power supply voltage VDDEL may be supplied to positive power supply terminal 200, whereas a ground power supply voltage VSSEL may be supplied to ground power supply terminal 202. Positive power supply voltage VDDEL may be 3 V, 4 V, 5 V, 6 V, 7 V, 2 to 8 V, or any suitable positive power supply voltage level. Ground power supply voltage VSSEL may be 0 V, −1 V, −2 V, −3 V, −4 V, −5 V, −6V, −7 V, or any suitable ground or negative power supply voltage level. The state of drive transistor Tdrive controls the amount of current flowing from terminal 200 to terminal 202 through diode 204 and therefore controls the amount of emitted light from display pixel 22.

Control signals from display driver circuitry such as row driver circuitry 34 of FIG. 2A are supplied to control terminals such as row control terminals 212 and 214. Row control terminal 212 may serve as an emission control terminal (sometimes referred to as an emission line or emission control line), whereas row control terminal 214 may serve as a scan control terminal (sometimes referred to as a scan line or scan control line). Emission control signal EM may be supplied to terminal 212. Emission control signal EM can be asserted to turn on transistor Tem during an emission phase to allow current to flow from the drive transistor Tdrive down to light-emitting diode 204. Scan control signal SC may be applied to scan terminal 214. A data input terminal such as data signal terminal 210 is coupled to a respective data line D of FIG. 2A for receiving image data for display pixel 22. Data terminal 210 may also be referred to as a data line. Scan signal SC can be asserted to turn on transistor Tdata during a data loading phase to write in a data signal value onto the storage capacitor Cst. Image data that is loaded into pixel 22 can be at least be partially stored on pixel 22 by using capacitor Cst to hold charge throughout the emission phase.

The pixel structure of FIG. 2B is mere illustrative and is not intended to limit the scope of the present embodiments. If desired, pixel 22 may include more or less than three thin-film transistors (e.g., including additional emission transistors, initialization transistors, anode reset transistors, etc.) and/or may include more or less than one capacitor.

Figure 3:
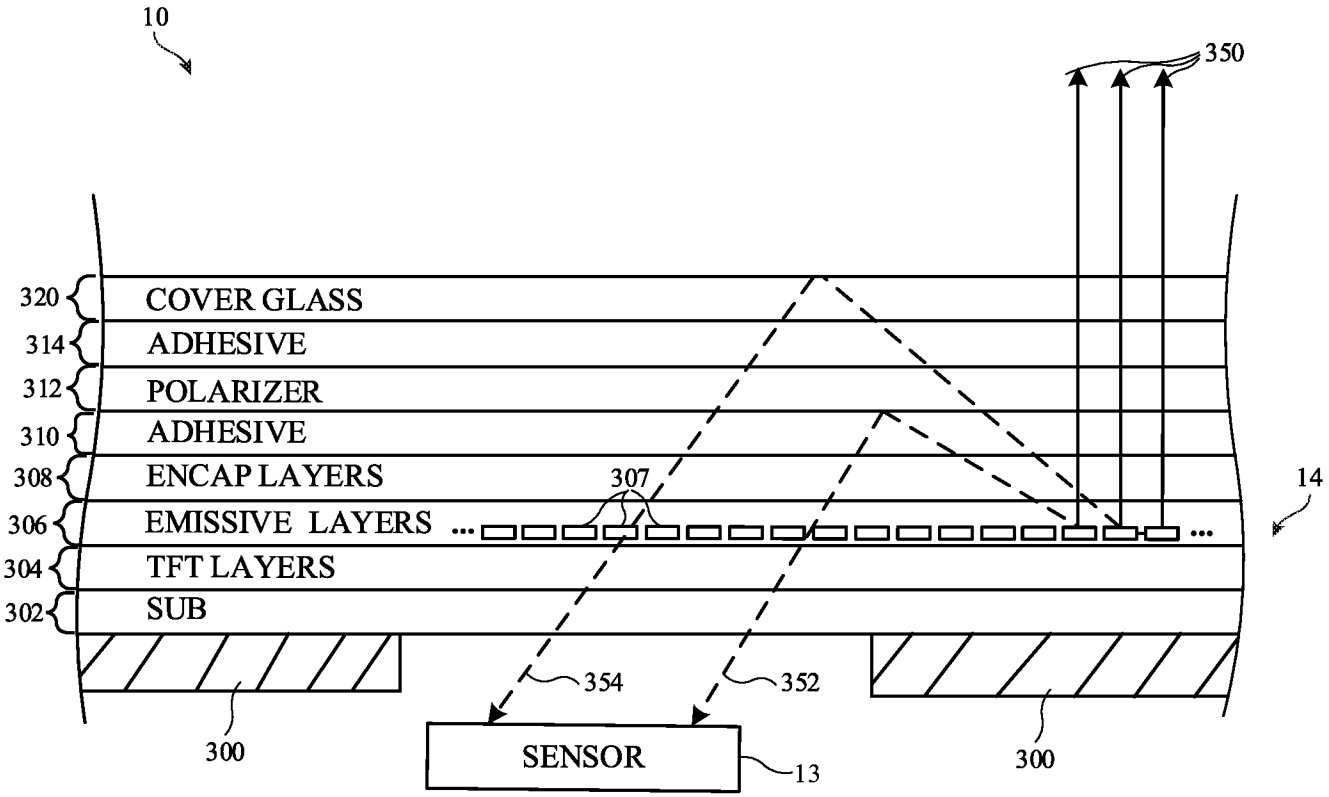
FIG. 3 is a cross-sectional side view of an illustrative display stack that at least partially covers a sensor in accordance with an embodiment.

FIG. 3 is a cross-sectional side view of device 10 having an illustrative display stack of display 14 that at least partially covers a sensor in accordance with an embodiment. As shown in FIG. 3, the display stack may include a substrate such as substrate 302. Substrate 302 may be formed from glass, metal, plastic, ceramic, sapphire, or other suitable substrate materials. In some arrangements, substrate 302 may be an organic substrate formed from polyimide (PI), polyethylene terephthalate (PET), or polyethylene naphthalate (PEN) (as examples). The surface of substrate 302 may optionally be covered with one or more buffer layers (e.g., inorganic buffer layers such as layers of silicon oxide, silicon nitride, etc.). A backing layer 300 may optionally be formed on the underside of substrate 302. For example, backing layer 300 may be a metal plate layer that provides mechanical support and/or electrical grounding for display 14. Backing layer 300 may also block visible and infrared light.

Thin-film transistor (TFT) layers 304 may be formed over substrate 302. The TFT layers 304 may include thin-film transistor circuitry such as thin-film transistors, thin-film capacitors, associated routing circuitry, and other thin-film structures formed within multiple metal routing layers and dielectric layers. Emissive layers 306 may be formed over the TFT layers 304. The emissive layers 306 may include a diode cathode layer, a diode anode layer (see, e.g., pixel anode electrode and pixelated diode layers 307, which may include emissive layers), and emissive material interposed between the cathode and anode layers. Emissive layers 306 may therefore sometimes be referred to as organic light-emitting diode (OLED) layers.

Circuitry formed in the TFT layers 304 and the emissive/OLED layers 306 may be protected by encapsulation layers 308. Encapsulation layers 308 may include a first inorganic encapsulation layer, an organic encapsulation layer formed on the first inorganic encapsulation layer, and a second inorganic encapsulation layer formed on the organic encapsulation layer. Encapsulation layers 308 formed in this way can help prevent moisture and other potential contaminants from damaging the conductive circuitry that is covered by layers 308.

One or more polarizer films 312 may be formed over the encapsulation layers 308 using adhesive 310. Adhesive 310 may be implemented using optically clear adhesive (OCA) material that offer high light transmittance. Lastly, the display stack may be topped off with a coverglass layer 320 that is formed over the polarizer layers 312 using additional adhesive 314 (e.g., OCA material). Cover glass 320 may serve as an outer protective layer for display 14. Device 10 may be further provided with one or more touch layers (not shown) for implementing touch sensor functions for a touch-screen display. As an example, the touch layers may be interposed between the cover glass layer and the polarizer layer. As another example, the touch layers may be interposed between encapsulation layers 308 and adhesive 310.

Still referring to FIG. 3, sensor 13 may be formed under the display stack within electronic device 10. As described above in connection with FIG. 1, sensor 13 may be an optical sensor such as a camera (e.g., an infrared camera), proximity sensor, ambient light sensor, fingerprint sensor, or other light-based sensor. In such scenarios, the performance of sensor 13 depends on the transmission of light traversing through the display stack. In practice, light emitted from the anode electrode and pixelated diode layers 307 (as shown by arrows 350) towards a user of device 10 may sometimes be reflected, deflected, diffracted, refracted, disbursed, or otherwise transmitted back towards the sub-display sensor 13. As one example, light emitted from the display pixels may be at least partially reflected back from the interface between polarizer layer 312 and encapsulation layers 308 (as shown by arrow 352). As another example, light emitted from the display pixels may be at least partially transmitted back from the interface between the cover glass layer 320 and the outside (air) environment, as shown by arrow 354. In general, light traversing through the display stack may be at risk of being emitted back towards sensor 13, a phenomenon sometimes referred to as "back emission." Back emission generated in this way can degrade the performance of sensor 13.

Figure 4:
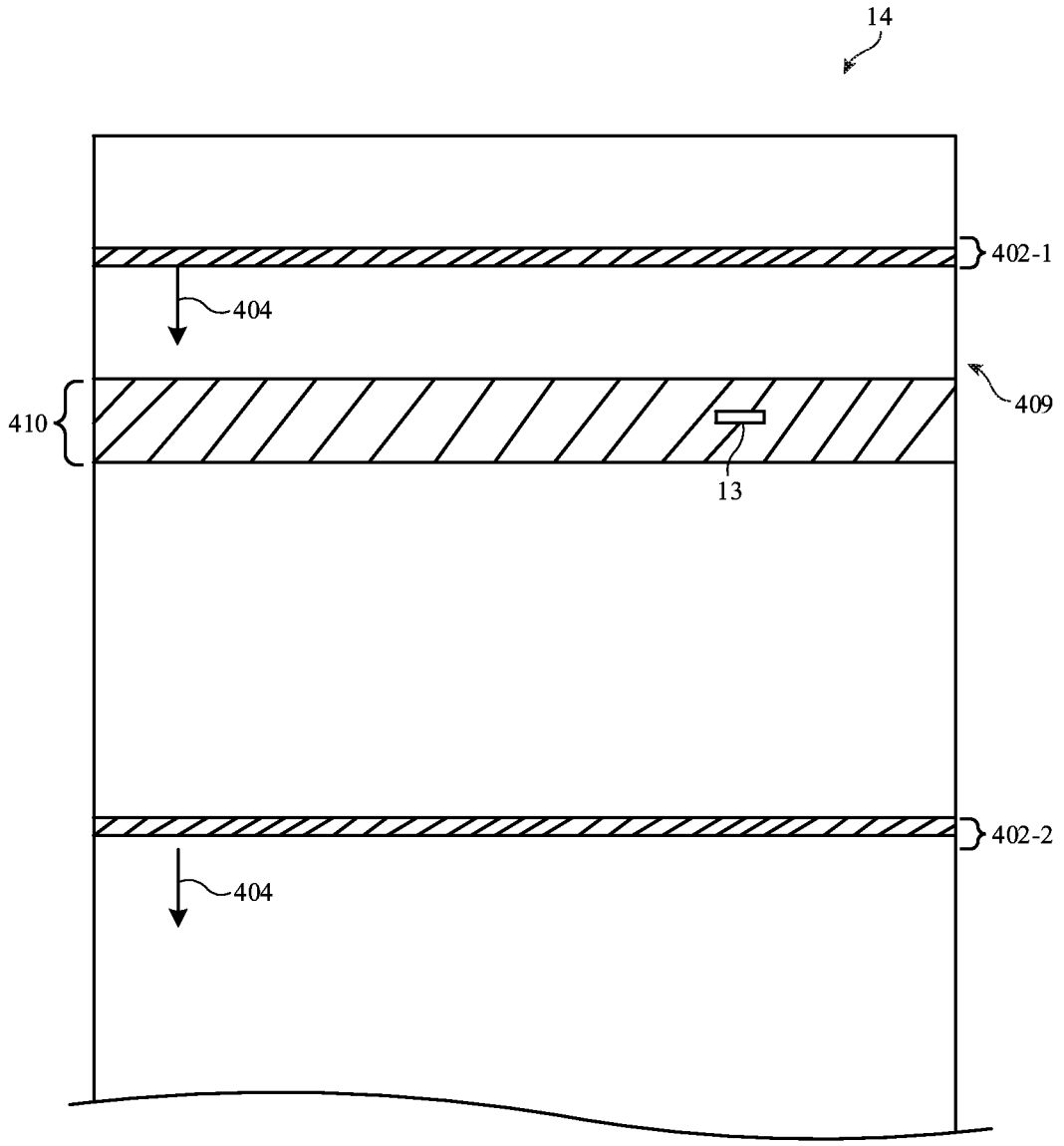
FIG. 4 is a top plan view of a display showing moving emission blanking lines and a static localized emission blanking region in accordance with an embodiment.

FIG. 4 is a top plan view of display 14 illustrating moving emission blanking lines and a static localized emission blanking region in accordance with an embodiment. As described above in connection with FIG. 2B, display pixels are often implemented using emission transistors controlled by emission signals. Asserting emission signals will turn on corresponding emission transistors to allow light to be emitted from the associated pixels, whereas deasserting emission signals will turn off corresponding emission transistors to prevent light from being emitted from the associated pixels. The emission signals may be controlled using a pulse-width modulation (PWM) scheme to adjust the brightness of display 14. In general, PWM provides adjustable digital dimming control at mid or low brightness levels because at lower brightness settings, it is more challenging to control the data voltage that is programmed into a pixel.

In a PWM scheme, the emission signals may be pulsed periodically. The pulse width of each emission (EM) pulse may determine the overall brightness of display 14. The pulse width of each EM pulse may be controlled by adjusting the duty cycle of the emission signal. In general, increasing the PWM duty cycle will increase the duration of the high phase of the EM pulse (thereby reducing the emission off phase), which would increase the overall brightness of display 14. The emission off phase during which the emission signal is deasserted is sometimes referred to as the emission "blanking" phase. Conversely, decreasing the PWM duty cycle will decrease the duration of the high phase of the EM pulse (thereby increasing the emission off phase), which would decrease the overall brightness of display 14. The frequency of the emission PWM pulsing may sometimes be referred to as an emission PWM rate, an emission blanking rate, or an emission PWM blanking rate.

Display 14 may have a native refresh frame rate of 60 Hz (as an example), a low refresh rate of less than 60 Hz (e.g., 1 Hz, 2 Hz, less than 10 Hz, less than 30 Hz, etc.), or a high refresh rate of greater than 60 Hz (e.g., 120 Hz, 144 Hz, 240 Hz, etc.). In certain embodiments, display 14 may be provided with an emission blanking rate that is equal to or greater than the native refresh rate. The emission blanking rate may be an integer multiple of the refresh rate. Consider an example in which display 14 has a nominal refresh/frame rate of 60 Hz and an emission blanking rate of 120 Hz. In this example where the PWM blanking rate is double the refresh rate, an emission signal with two pulses per frame time will propagate through the display, which will also result in two complementary blanking phases during which the associated pixel rows will be turned off.

This is illustrated by the emission blanking lines such as first blanking lines 402-1 and second blanking lines 402-2 in FIG. 4. First blanking lines 402-1 and second blanking lines 402-2 may include the same number of rows (e.g., 20 consecutive pixel rows, 30 consecutive pixel rows, 40 consecutive pixel rows, 50 consecutive pixel rows, 10-100 consecutive pixel rows, or other suitable number of consecutive pixel rows) and may be separated by approximate half of the total number of rows assuming a 1:2 refresh-to-PWM ratio. Blanking lines 402-1 and 402-2 (sometimes also referred to as blanking rows or blanking strips of pixels) may propagate down the display, as indicated by arrows 404. The number of consecutive blanking rows in each of lines 402-1 and 402-2 may be limited to a predetermined threshold to avoid a strobing or flickering effect that might be visible to the user. Increasing the PWM duty cycle will reduce the number of consecutive blanking rows in strips 402-1 and 402-2 (thus increase the overall display brightness), whereas decreasing the PWM duty cycle will increase the number of consecutive blanking rows in each of strips 402-1 and 402-2 (thus decreasing the overall display brightness).

In accordance with an embodiment, display 14 may be further provided with a static emission blanking region 410 that is localized around sensor 13. Unlike the emission blanking lines 402 that propagate down the display panel, emission blanking region 410 remains static and may therefore sometimes be referred to as a static localized emission blanking (or "EM off") region, dedicated sensor blackout region, or localized sensor blackout region. In the example of FIG. 4, static localized EM off region 410 includes more consecutive blanking rows than either of lines 402-1 or 402-2. For instance, region 410 may include more than 50 consecutive pixel rows, more than 100 consecutive pixel rows, more than 150 pixel rows, 100-200 consecutive pixel rows, more than 200 consecutive pixel rows, more than 300 adjoining pixel rows, or other suitable number of consecutive pixel rows.

Providing static blanking region 410 that is localized around and overlapping with sensor 13 shuts off all the display pixels within region 410 while sensor 13 is detecting incoming light, which can dramatically reduce undesired back emission during sensing operations and thus improve sensor performance. Augmenting the size of region 410 may increase the distance from sensor 13 to the nearest emitting display pixel outside region 410, which can further reduce the total amount of unwanted back emission. In general, sensor 13 should be placed in the halfway down region 410 for maximum reduction in back emission (e.g., the number of pixel rows separating sensor 13 to the top edge of region 410 should be approximately equal to the number of pixel rows separating sensor 13 to the bottom edge of region 410).

Figure 5:
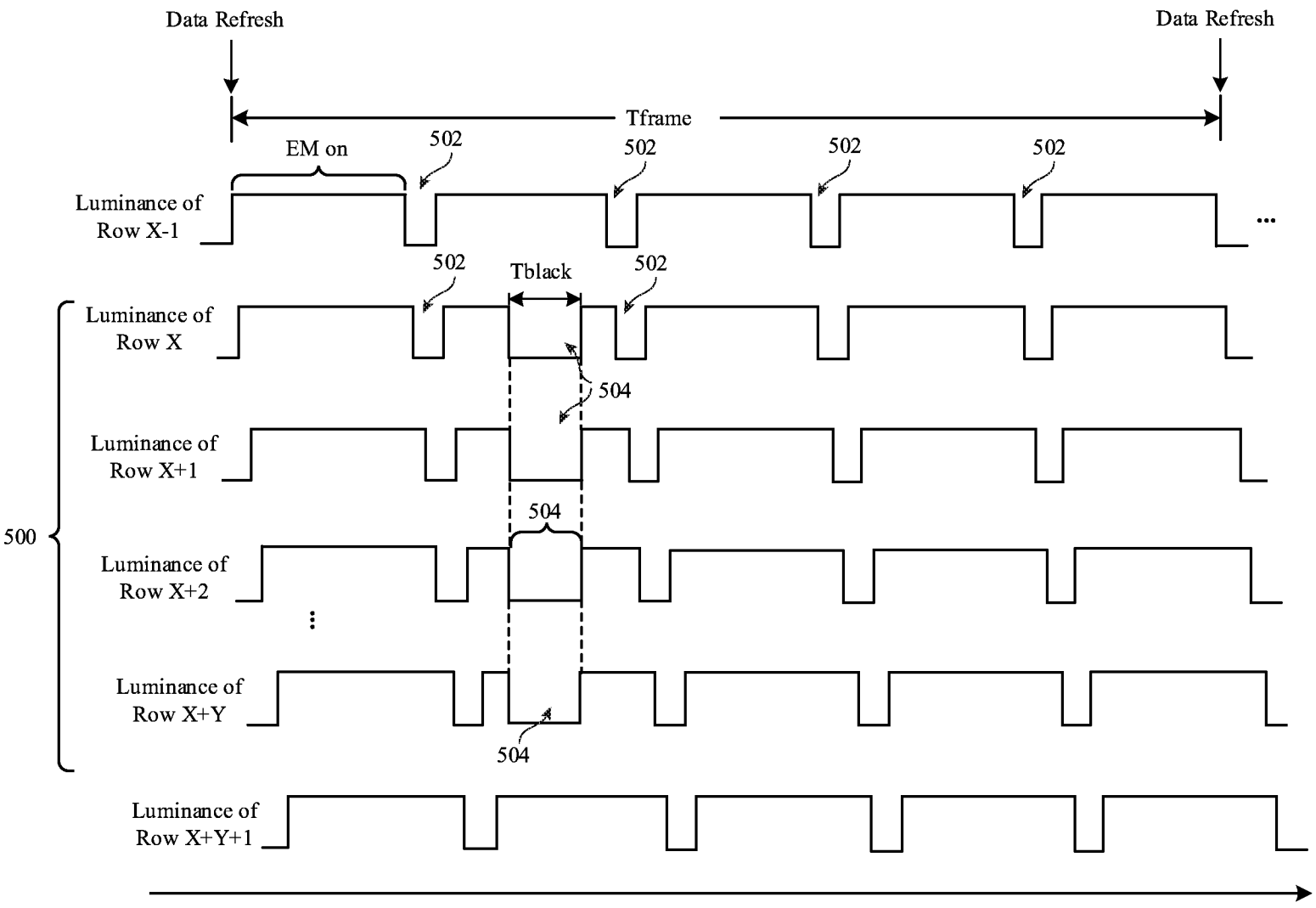
FIG. 5 is a timing diagram illustrating only one localized emission blanking pulse per frame for each pixel row in the static localized emission blanking region in accordance with an embodiment.

The example described above in which the emission (EM) PWM blanking rate is twice the native refresh rate is merely illustrative. FIG. 5 illustrates another example in which the EM PWM blanking rate is four times the native refresh/frame rate (e.g., the frame rate may be 60 Hz, whereas the PWM rate may be 240 Hz). In particular, FIG. 5 shows the luminance of a number of rows in the display over time. Row (X−1) may represent the pixel row immediately preceding the localized sensor blackout region (see row 409 in FIG. 4). Rows X to (X+Y) may represent the pixel rows within the localized sensor blackout region (see rows 500). Row (X+Y+1) may represent the pixel row immediately following the localized sensor blackout region. As shown in FIG. 5, each of the rows may see four PWM blanking pulses 502 during a frame period Tframe (assuming a 1:4 refresh to EM-PWM ratio). The four PWM blanking pulses 502 may propagate down the display panel, as illustrated by the slightly staggered (time-offset) pulses across the rows in the time domain.

In addition to the PWM blanking pulses 502, FIG. 5 also shows how the rows 500 that are located within the localized sensor blackout region may be further provided with localized emission blanking pulses 504 (sometimes also referred to as sensor blackout pulses). Only the pixels in the localized sensor blackout region receive emission signals with sensor blackout pulses 504. Unlike the PWM blanking pulses 502 that are slightly offset in time from row to row, the sensor blackout pulses 504 may be synchronized in time (i.e., pulses 504 for each of rows 500 may be pulsed simultaneously). Each sensor blackout pulse 504 may have a blanking duration Tblack that is adjustable. Increase pulse duration Tblack would effectively increase the size of region 410 (i.e., to increase the total number of pixel rows within the sensor blackout region), whereas decreasing pulse duration Tblack would effectively reduce the size of region 410 (i.e., to reduce the total number of pixel rows in the sensor blackout region). In general, sensor blackout pulse 504 may occur once in a frame (as shown in FIG. 5), multiple times per frame, or in an on-demand basis once in a few refresh frames or multiple times in a refresh frame.

Figure 6:
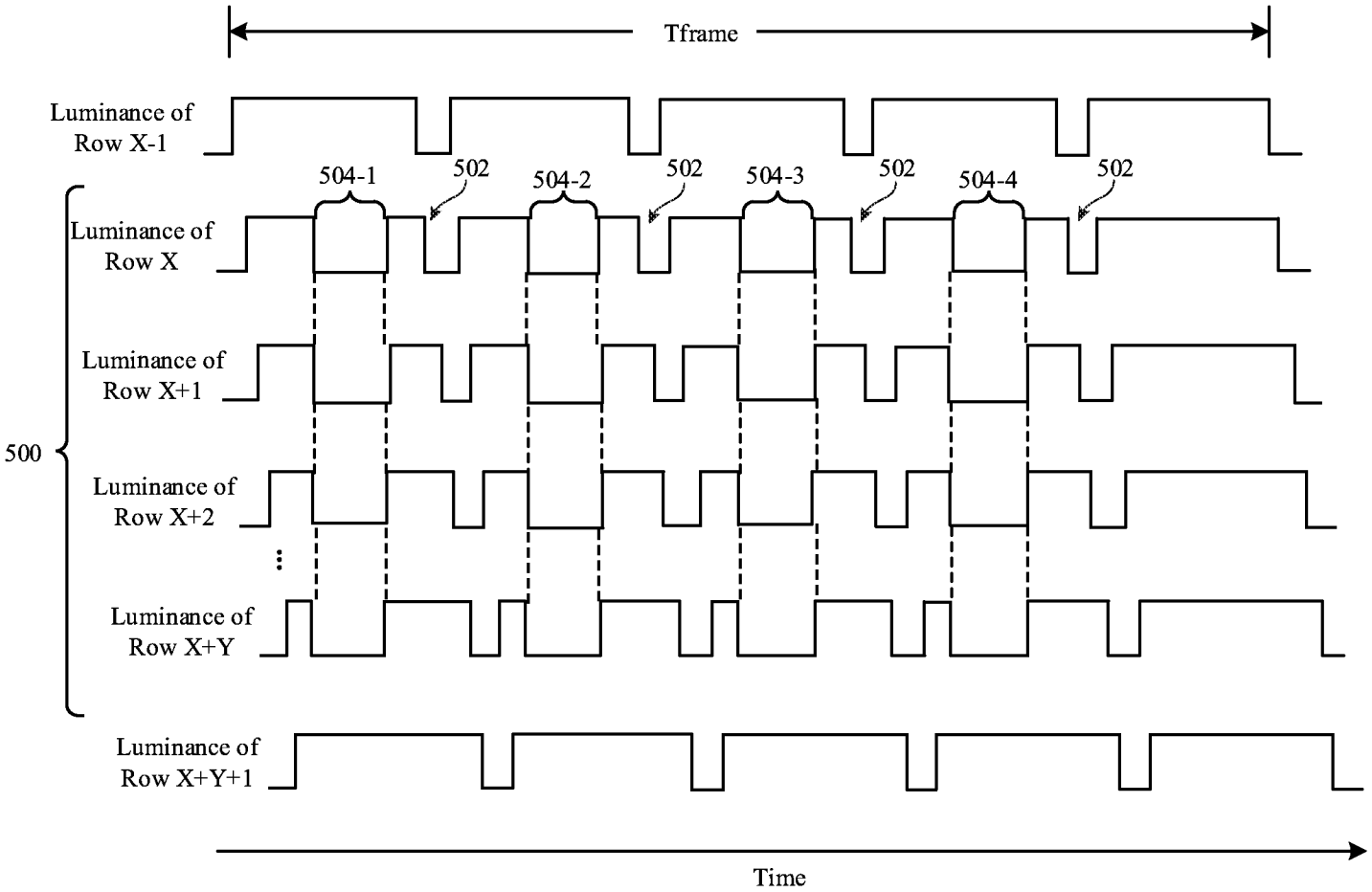
FIG. 6 is a timing diagram illustrating multiple localized emission blanking pulses per frame for each pixel row in the static localized emission blanking region in accordance with an embodiment.

The example of FIG. 5 in which each row 500 within the sensor blackout region exhibits one sensor blackout pulse 504 is merely illustrative and is not intended to limit the scope of the present embodiments. FIG. 6 illustrates another example where each row sees multiple sensor blackout pulses 504. As shown in FIG. 6, each row 500 within the sensor blackout region will experience four sensor blackout pulses 504-1, 504-2, 504-3, and 504-4. For example, the native refresh/frame rate may be 60 Hz, the blanking PWM rate may be 240 Hz, and the rate at which the sensor blackout pulses are occurring (sometimes referred to as the sensor blackout pulse rate) is also at 240 Hz. In this example, the sensor blackout pulse rate is equal to the emission PWM blanking rate since the number of PWM blanking pulses 502 and the number of sensor blackout pulses 504 in a single Tframe are identical. If desired, the PWM blanking rate and the sensor blackout pulse rate may be different. The PWM blanking rate may generally be equal to or greater than the sensor blackout pulse rate. In yet other suitable embodiments, the PWM blanking may optionally be less than the sensor blackout pulse rate.

Figure 7:
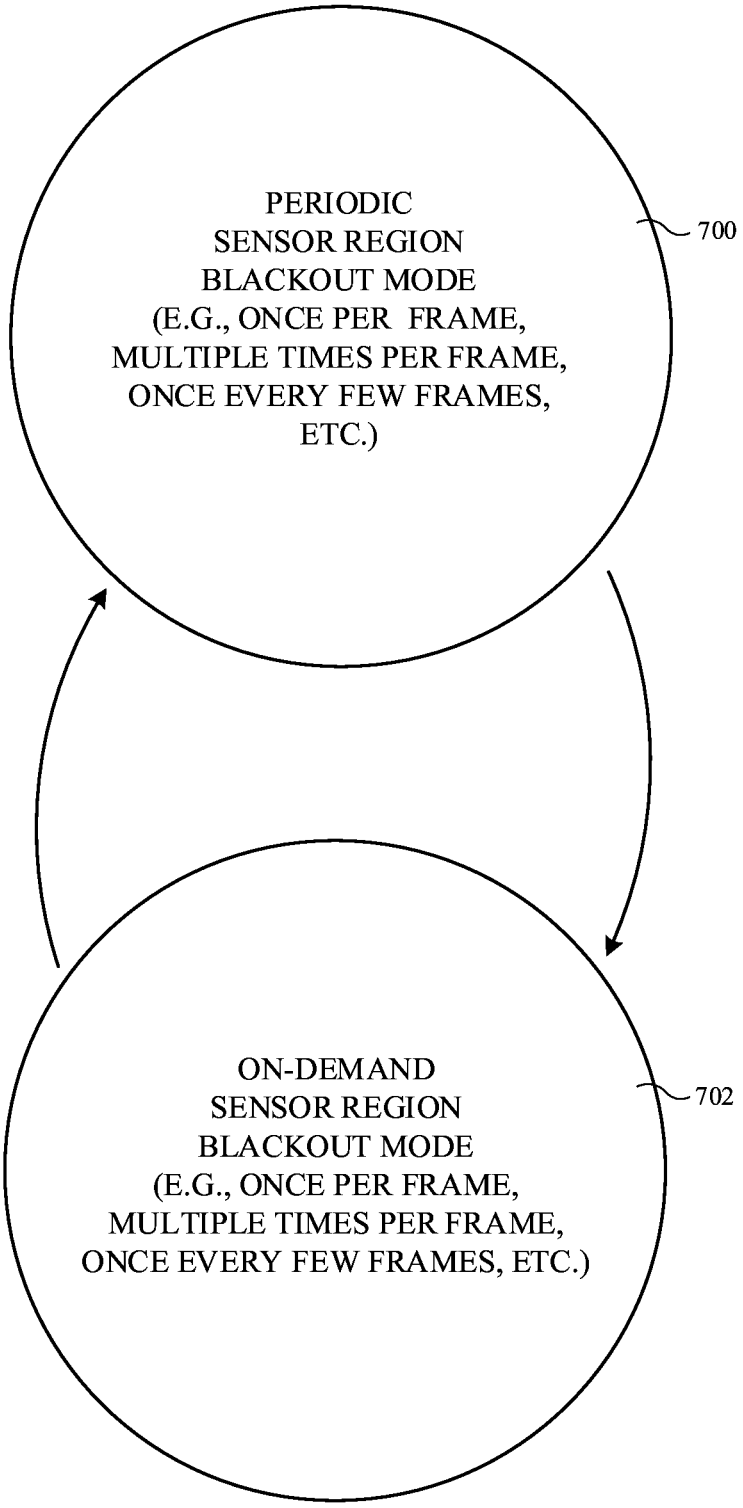
FIG. 7 is a diagram showing how a display may be operable in a periodic sensor region blackout mode and in an on-demand sensor region blackout mode in accordance with an embodiment.

FIG. 7 is a diagram showing how display 14 may be operable in a periodic sensor region blackout mode 700 and in an on-demand sensor region blackout mode 702. When display 14 is operated in the periodic sensor region blackout mode 700, the sensor blackout pulses 504 of the type described in connection with FIGS. 5 and 6 may occur automatically once per frame (as shown in the example of FIG. 5), may occur automatically multiple times per frame (as shown in the example of FIG. 6), or may occur on a periodic basis once every certain number of frames (e.g., once every two frames, once every three frames, once every four frames, once every 2-10 frames, etc.). During mode 700, the interval between successive sensor blackout pulses 504 will be constant and may therefore maintain a constant relationship (time offset) with respect to the PWM blanking pulses 502.

When display 14 is operated in the on-demand sensor region blackout mode 702, the sensor blackout pulses 504 of the type described in connection with FIGS. 5 and 6 may occur on-demand once per frame, may occur on-demand multiple times per frame, or may occur once very few frames in an on-demand basis. During mode 702, there is no constraint on the time interval between successive sensor blackout pulses 504, so the sensor blackout pulses need not maintain a constant relationship (time offset) with the periodic PWM blanking pulses 502.

Figure 8A:
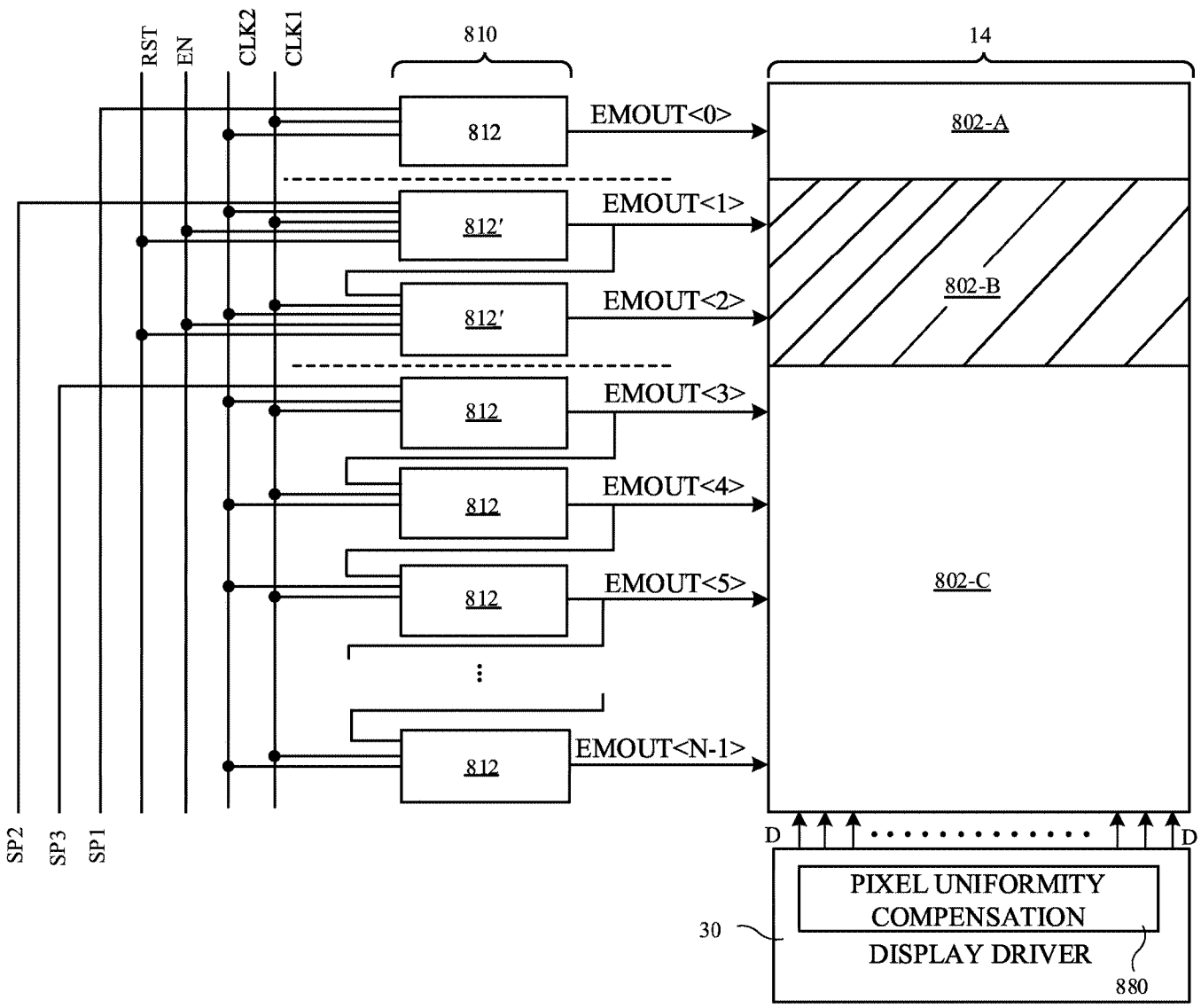
FIG. 8A is a diagram showing illustrative emission gate drivers configured to receive multiple start pulses for generating emission signals to different zones on a display in accordance with an embodiment.

The emission PWM blanking scheme and the localized sensor blackout scheme described in connection with FIGS. 4-7 may be implemented using emission gate driver circuits such as emission gate driver circuitry 810 of FIG. 8A. Emission gate driver circuitry 810 may be part of the gate driver circuitry 34 shown in FIG. 2A. As shown in FIG. 8A, emission gate driver circuitry 810 may include one or more emission gate drivers 812 configured to drive a first portion 802-A of display 14 (i.e., a first display portion preceding the localized sensor blackout region), multiple emission gate drivers 812' configured to drive a second portion 802-B of display 14 (i.e., a second display portion overlapping with the localized sensor blackout region), and multiple emission gate drivers 812 configured to drive a third portion 802-C of display 14 (i.e., a third display portion following the localized sensor blackout region). The example of FIG. 8A in which portion 802-A only includes one pixel row and portion 802-B includes only two pixels rows is merely illustrative. In general, each of the first display portion 802-A and the third display portion 802-C may include tens, hundreds, or thousands of pixel rows driven using corresponding emission gate drivers 812, and the second display portion 802-B may also include, tens, hundreds, or thousands of pixel rows driven by associated emission gate drivers 812'.

Each emission gate driver 812 and 812' may receive a first clock signal CLK1 and a second clock signal CLK2. Second clock signal CLK2 may be a time delayed version of the first clock signal CLK1. Only emission gate drivers 812' corresponding to display portion 802-B may be configured to receive additional control signals such as a localized sensor blackout enable signal EN and a localized sensor blackout reset signal RST. Additional control signals EN and RST may be used to generate the localized sensor blackout pulses (e.g., pulses 504 shown in FIGS. 5-6).

In the example of FIG. 8A, the various emission gate drivers within circuitry 810 are not all connected in a continuous chain. For instance, while the emission gate drivers 812 driving display portion 802-C are connected in a chain (see, e.g., the output of the emission gate driver outputting EMOUT<3> is connected to an input of the succeeding emission gate driver; the output of the emission gate driver outputting EMOUT<4> is connected to an input of the succeeding emission gate driver; the output of the emission gate driver outputting EMOUT<5> is connected to an input of the succeeding emission gate driver; and so on), the emission gate drivers bridging portions 802-A and 802-B are not connected (i.e., the output of the emission gate driver generating EMOUT<0> is not connected to the input of driver of the emission gate driver generating EMOUT<1>). The emission gate drivers bridging portions 802-B and 802-C are also not connected (i.e., the output of the emission gate driver generating EMOUT<2> is not connected to the input of driver of the emission gate driver generating EMOUT<3>). Since the emission gate drivers are not all connected in a chain, multiple start pulses will be needed to trigger the first emission gate driver of each portion. In the configuration of FIG. 8A, a first start pulse signal SP1 is used to initiate the first emission gate driver circuit 812 driving display portion 802-A, a second start pulse signal SP2 is used to initiate the first emission gate driver circuit 812' driving display portion 802-B, and a third start pulse signal SP3 is used to initiate the first emission gate driver circuit 812 driving display portion 802-C.

Figure 8B:
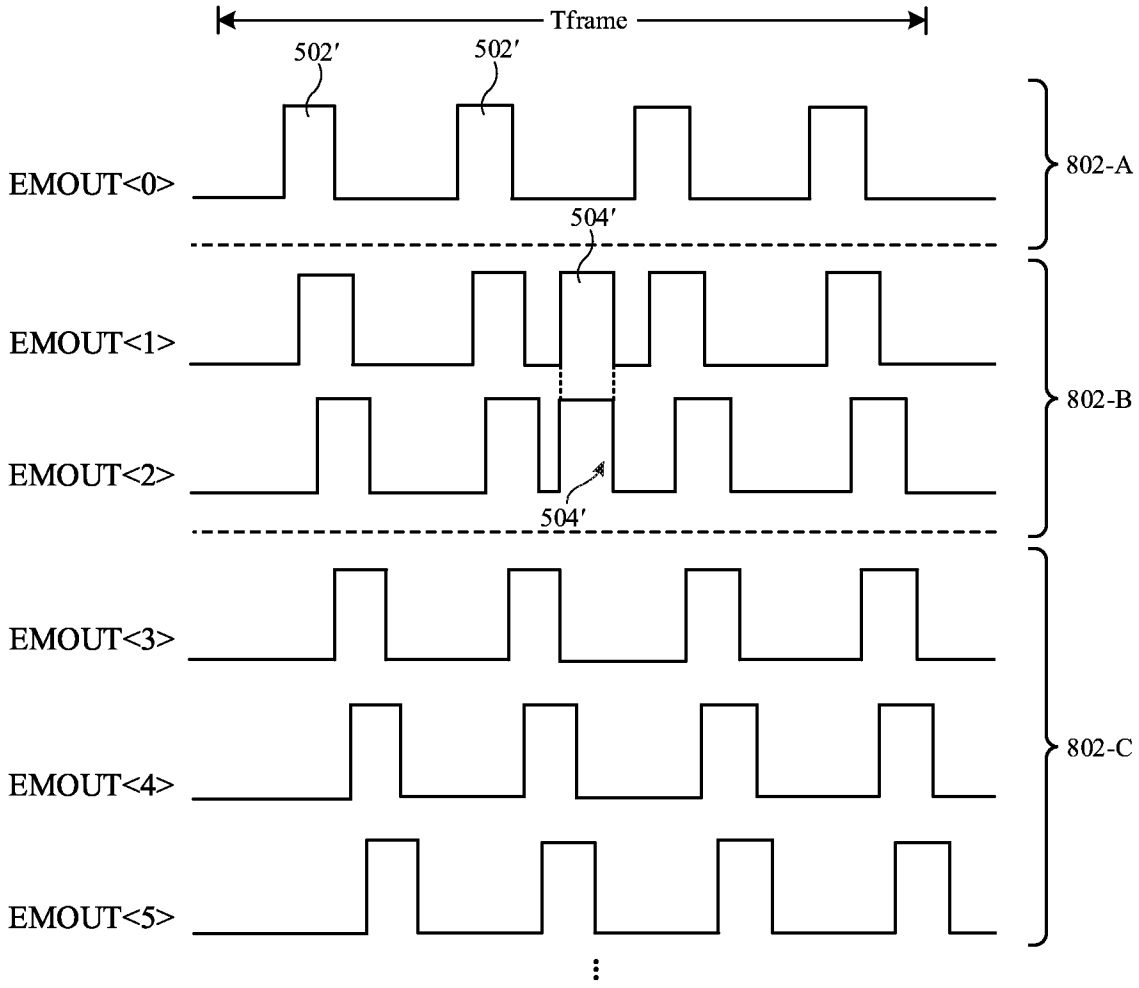
FIG. 8B is a timing diagram showing illustrative emission signals generated by the emission gate drivers of FIG. 8A in accordance with an embodiment.

FIG. 8B is a timing diagram showing illustrative emission signals generated by the emission gate drivers of FIG. 8A. A shown in FIG. 8B, emission signal EMOUT<0> may have four pulses 502' within a single frame time. This assumes a display pixel having a p-type emission transistor, where the emission transistor is an active-low switch and is therefore turned off when the emission signal received at its gate terminal is driven high. Thus, the four high pulses 502' in EMOUT<0> will produce the four PWM blanking pulses 502 shown and described in connection with FIGS. 5 and 6. The emission signals EMOUT<3:5> corresponding to display portion 802-C may also have the same number of PWM blanking pulses per frame, albeit with pulses staggered in time as the emission pulses are propagated down the chain from one emission gate driver 812 to the next.

In contrast to the emission control signals corresponding to portions 802-A and 802-C, emission signals EMOUT<1> and EMOUT<2> driving display blackout portion 802-B may further include one or more emission signal blackout pulses 504' that are synchronized in time. In the example of FIG. 8B, emission signal EMOUT<1> has a blackout pulse 504' that is aligned in time with respect to the blackout pulse 504' of emission signal EMOUT<2> also driving a pixel row in the sensor blackout region. This also assumes a display pixel having a p-type emission transistor, where the emission transistor is an active-low switch and is therefore turned off when the emission signal received at its gate terminal is driven high. Thus, the single pulse 504' in EMOUT<1> and EMOUT<2> will produce a corresponding sensor blackout pulse 504 shown and described in connection with FIG. 5.

Figure 8C:
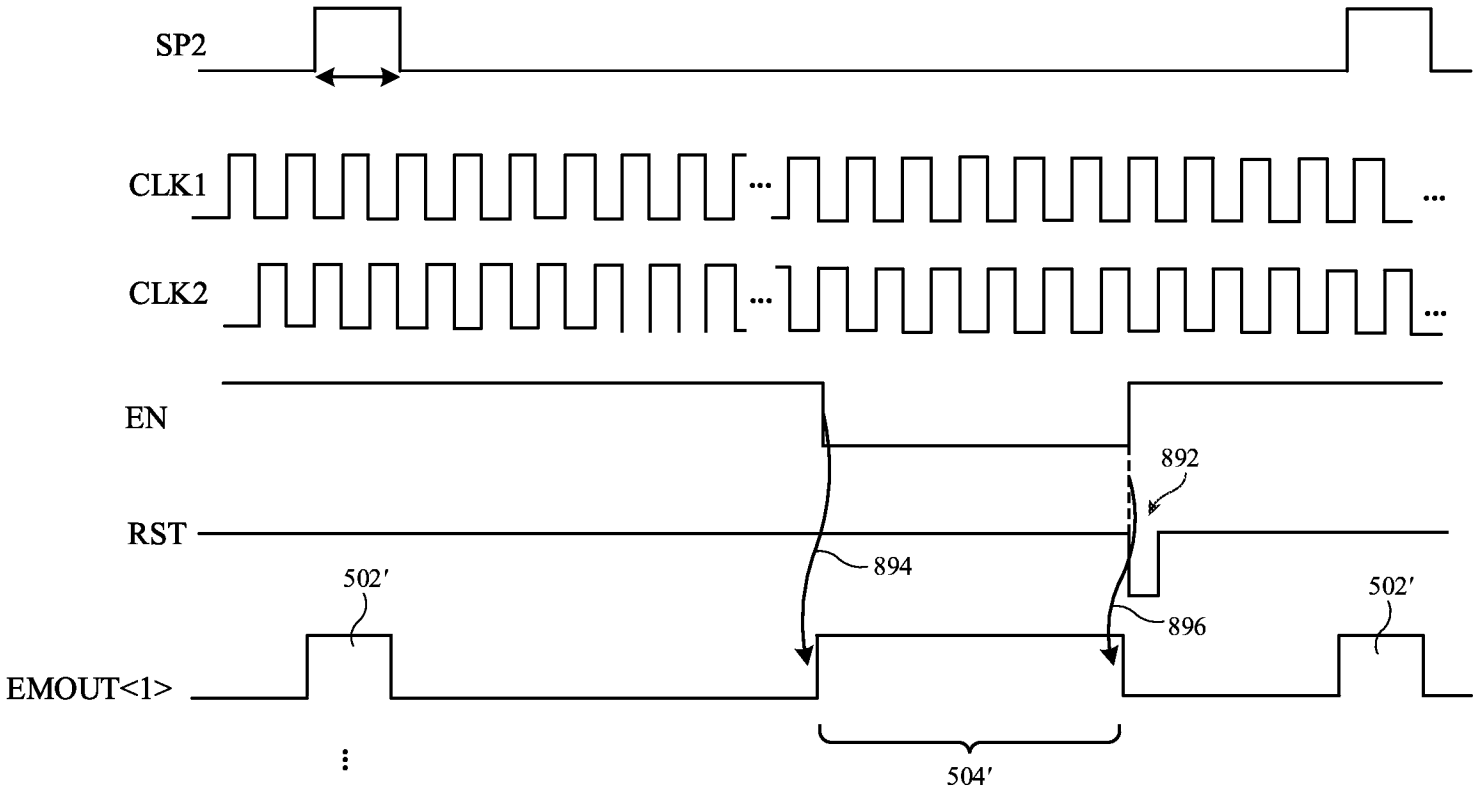
FIG. 8C is a timing diagram showing how a localized emission blanking pulse can be generated using enable and reset signals in accordance with an embodiment.

FIG. 8C is a timing diagram showing how a localized sensor blackout pulse can be generated using enable and reset signals. As shown in FIG. 8C, clock signals CLK1 and CLK2 may toggle at a much higher frequency than the rate at which the emission signals are pulsed in each row. The second start pulse signal SP2 may trigger the first emission gate driver 812' driving a first pixel row in the sensor blackout region to output a first emission PWM blanking pulse 502'. To generate an additional sensor blackout pulse 504' between successive PWM blanking pulses, the enable signal EN may be asserted (e.g., driven low), which causes all the emission signals associated with display portion 802-B to be driven high (as indicated by arrow 894). At a later point in time, the reset signal RST may be pulsed (see, e.g., pulse 892), which cases all the emission signals associated with display portion 802-B to be driven back low (as indicated by arrow 896), thereby ending the sensor blackout phase. The enable signal EN should be deasserted (e.g., driven high) before the reset signal is pulsed to prevent an emission pulse from propagating to the next stage. The timing between the falling edge of signal EN and the subsequent pulse edge of signal RST may optionally be tuned to adjust the width of pulse 504'.

Figure 9:
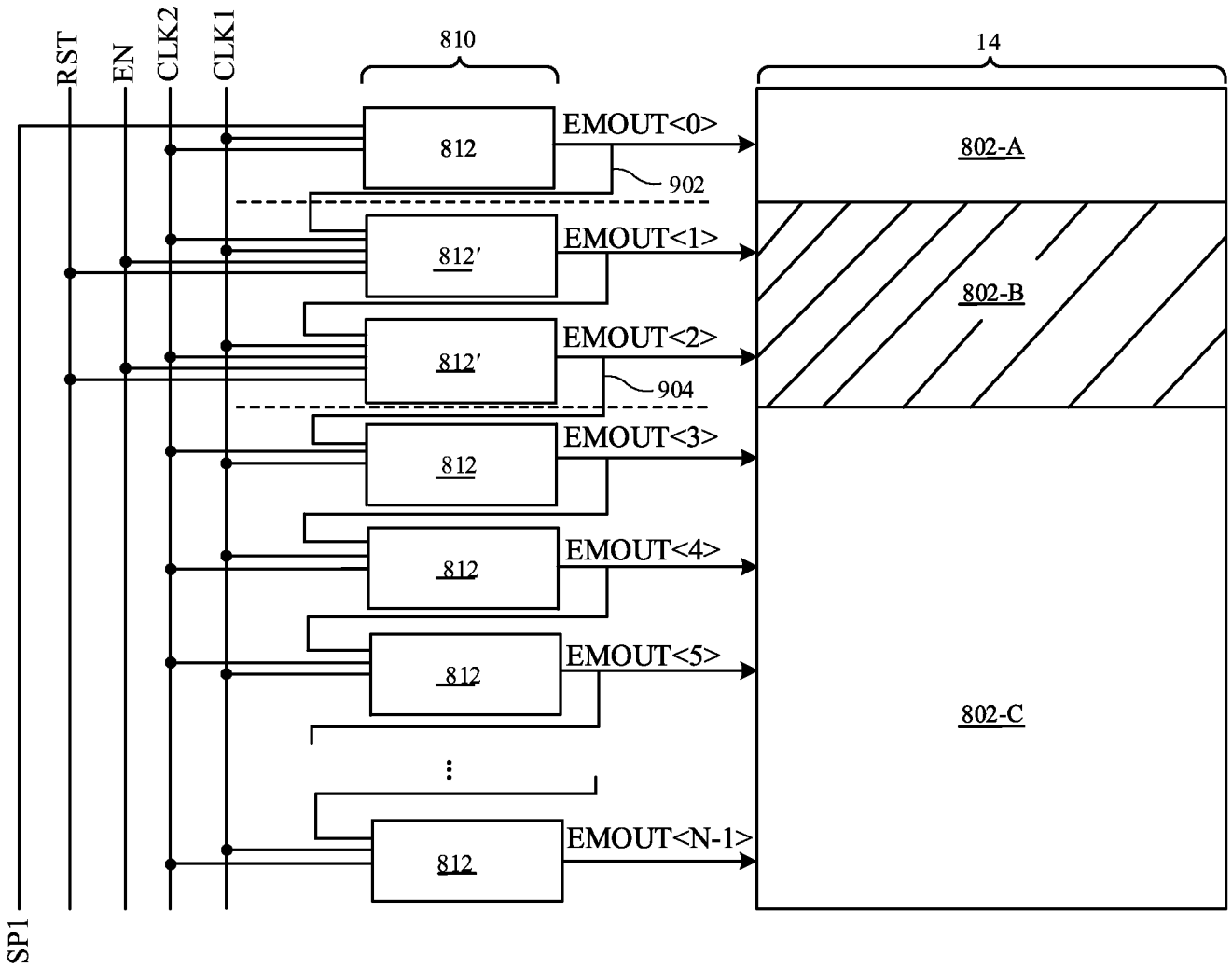
FIG. 9 is a diagram showing an illustrative chain of emission gate drivers configured to generate emission signals to different zones on a display in accordance with an embodiment.

FIG. 9 illustrates another suitable arrangement in which the various emission gate drivers within circuitry 810 are all connected in a continuous chain. For instance, even the emission gate drivers bridging portions 802-A and 802-B are connected (i.e., the output of the emission gate driver generating EMOUT<0> is connected to the input of driver of the emission gate driver generating EMOUT<1> as indicated by feedforward connection path 902). Similarly, the emission gate drivers bridging portions 802-B and 802-C are also connected (i.e., the output of the emission gate driver generating EMOUT<2> is connected to the input of driver of the emission gate driver generating EMOUT<3> as indicated by feedforward connection path 904). Since the emission gate drivers are all connected in a chain, only one start pulse SP1 is needed to trigger the first leading emission gate driver driving the first pixel row. Additional control signals EN and RST will still need to be provided to emission gate drivers 812' to generate the localized sensor blackout pulses for display portion 802-B.

Figure 10A:
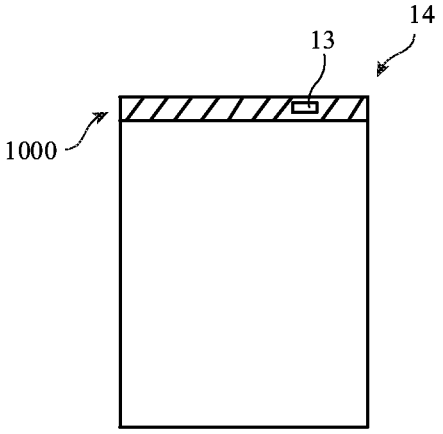
FIGS. 10A-10F are diagrams illustrating various arrangements in which a display can be configured to support one or more localized emission blanking regions associated with sensor(s) placed at different locations under the display in accordance with an embodiment.
Figure 10B:
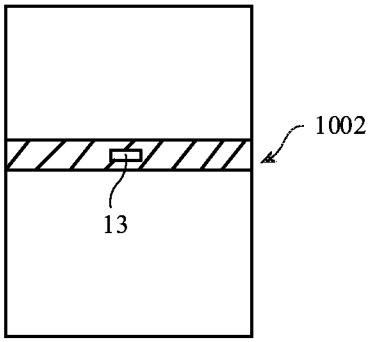
Figure 10C:
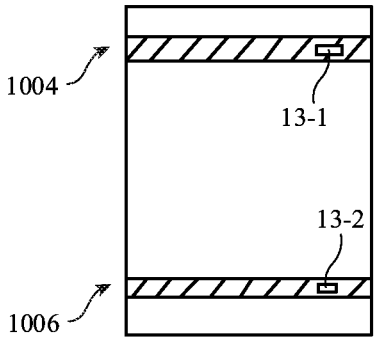

The embodiments described in connection with FIGS. 3-9 where display 14 is provided with one sensor and one associated localized sensor blackout region is merely illustrative and is not intended to limit the scope of the present embodiments. FIGS. 10A-10F illustrate various arrangements in which display 14 can be configured to support one or more localized sensor blackout regions associated with sensor(s) placed at different locations under the display. FIG. 10A shows how display 14 may have one sensor 13 positioned near the edge of the display, so a localized sensor blackout region 1000 may be provided along an entire edge of the display. FIG. 10B shows how display 14 may have one sensor 13 positioned near the center of the display, so a localized sensor blackout region 1002 may be provided that overlaps with the center of the display. FIG. 10C shows how display 14 may have multiple sensors 13-1 and 13-2 positioned at different portions of the display, so multiple localized sensor blackout regions 1004 and 1006 may overlap with sensors 13-1 and 13-2, respectively.

Figure 10D:
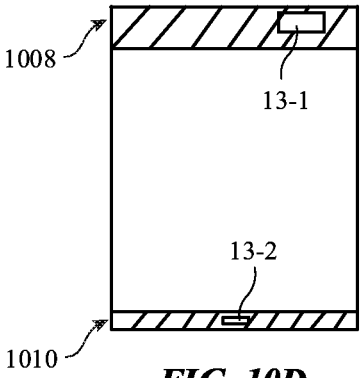
Figure 10E:
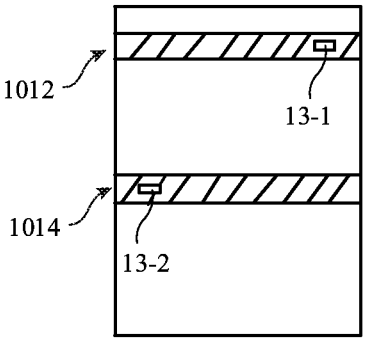
Figure 10F:
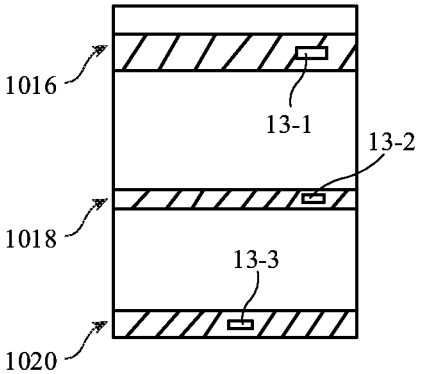

FIG. 10D shows how display 14 may have multiple sensors 13-1 and 13-2 positioned near the top and bottom edge of the display, so multiple localized sensor blackout regions 1008 and 1010 may be provided along the top and bottom edges of the display. FIG. 10E shows how display 14 may have a first sensor 13-1 positioned near a border of the display and a second sensor 13-2 positioned near the center of the display, so multiple localized sensor blackout regions 1012 and 1014 may overlap with sensors 13-1 and 13-2, respectively. FIG. 10F shows yet another suitable arrangement of display 14 with three sensors 13-1, 13-2, and 13-3 overlapped by three different localized sensor black regions 1016, 1018, and 1020, respectively.

The examples of FIG. 10A-10F are merely illustrative. If desired, display 14 may be provided with more than three sensors or any suitable number of under-display sensors positioned at various locations in the device. All of the sensors may be overlapped by an associated sensor blackout region or only a subset of the sensors may be overlapped by a sensor blackout region. If desired, two or more sensors may be overlapped by a single sensor blackout region (if the sensors are located along the same rows or near the same rows). Moreover, the sensor blackout region need not extend the entire row of display 14 (e.g., each localized sensor blackout region might only cover a subset of the columns in each row).

Figure 11A:
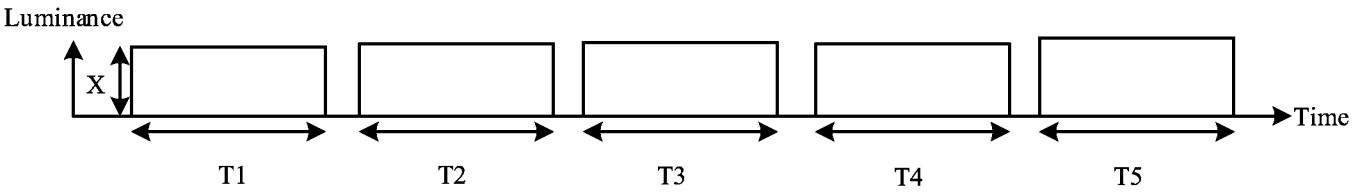
FIGS. 11A-11D are timing diagrams illustrating various ways of improving display luminance uniformity in accordance with an embodiment.
Figure 11B:
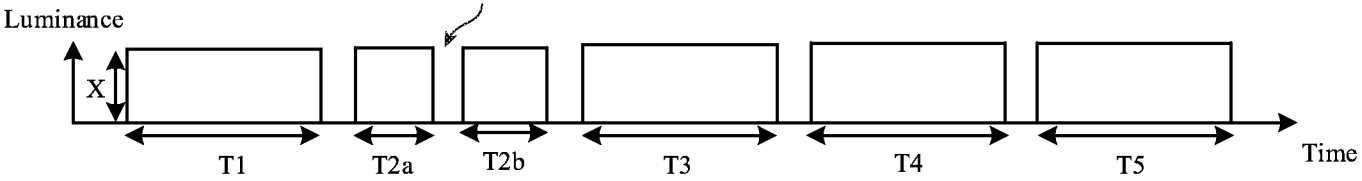

FIG. 11A illustrates the luminance over time for a pixel row outside the localized sensor blackout region (see, e.g., a pixel row in display portion 802-A or 802-C in FIG. 9). As shown in FIG. 11A, each emission on period may have a luminance magnitude "x" and durations T1, T2, T3, T4, and T5 (as an example). The total luminance may therefore be equal to x*(T1+T2+T3+T4+T5). FIG. 11B illustrates the luminance over time for a pixel row within the localized sensor blackout region (see, e.g., a pixel row in display portion 802-B in FIG. 9). As shown in FIG. 11B, a sensor blackout pulse 504 may carve out a period during which the emission is actively turned off. The total luminance may therefore be equal to x*(T1+T2a+T2b+T3+T4+T5), where (T2a+T2b) is less than T2. Comparing the total luminance of FIG. 11A with that of FIG. 11B, we can see that the total luminance of FIG. 11B will be slightly less than that of FIG. 11A due to the sensor blackout pulse.

Figure 11C:
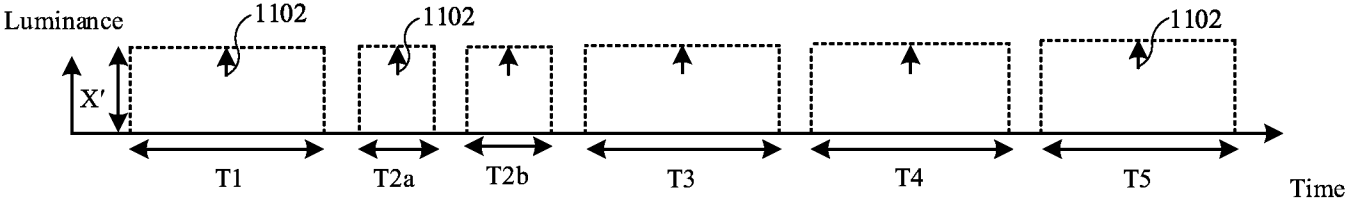

To compensate for this slight drop in luminance, FIG. 11C illustrates one approach that boosts the luminance of the remaining emission on times (e.g., luminance is boosted from magnitude x to x', as indicated by arrow 1102). The overall luminance of FIG. 11C may therefore be equal to x'*(T1+T2a+T2b+T3+T4+T5), where x' represents the boosted value that would help this expression be equal to the nominal luminance of FIG. 11A.

Figure 11D:
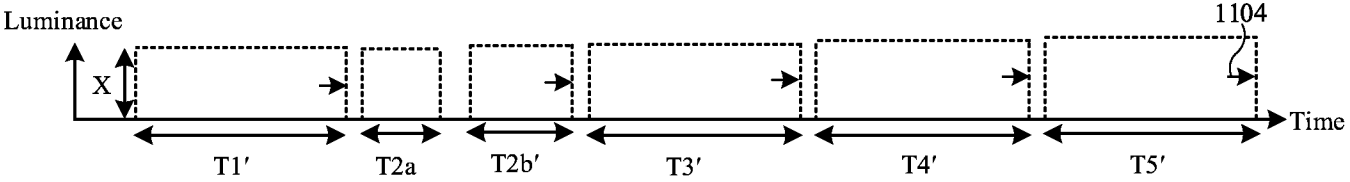

FIG. 11D illustrates yet another approach that lengthens each of the emission on times (e.g., each emission on pulse is extended in time, as indicated by arrow 1104). The overall luminance of FIG. 11C may therefore be equal to x*(T1'+T2a+T2b'+T3'+T4'+T5'), where T1', T2b', T3', T4', and T5' represents the augmented duration of each EM on period that would help this expression be equal to the nominal luminance of FIG. 11A. If desired, the luminance magnitude compensation approach of FIG. 11C, the time domain compensation approach of FIG. 11D, some other luminance compensation method, or a combination thereof may be used to help compensate for any visible luminance drop in the sensor black region to help achieve luminance uniformity across the entire display 14.

The various luminance compensation schemes may be implemented using a compensation circuit such as pixel uniformity compensation (PUC) circuit 880 shown in FIG. 8A (as an example). As shown in FIG. 8A, pixel luminance uniformity compensation circuit 880 may be formed as part of the display driver circuitry 30 to selectively increase the luminance levels of data signals being fed to pixels in portion 802-B (e.g., by proactively boosting the data signal values intended for the pixels in the sensor blackout region) and/or to extend each or at least some of the emission on periods for the pixels in portion 802-B.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a display; and a sensor configured to receive light through the display, wherein:

the display comprises a sensor blackout region that overlaps with the sensor;

pixels in the sensor blackout region are prevented from emitting light while the sensor is detecting light through the display;

at least one of the pixels comprises a light-emitting diode and an emission transistor coupled in series with the light-emitting diode;

the emission transistor is configured to receive an emission signal having a plurality of periodic blanking pulses and a sensor blackout pulse between two successive blanking pulses in the plurality of periodic blanking pulses for producing the sensor blackout region.

2. The electronic device of claim 1, wherein the sensor blackout region is at a static location on the display.

3. The electronic device of claim 1, wherein only the pixels in the sensor blackout region receive emission signals with the sensor blackout pulse.

4. The electronic device of claim 1, wherein the sensor blackout pulse has an adjustable pulse width for adjusting the size of the sensor blackout region.

5. The electronic device of claim 1, wherein at least two rows of pixels in the sensor blackout region are configured to receive emission signals having sensor blackout pulses that are simultaneously pulsed.

6. The electronic device of claim 1, wherein the display has a refresh rate with a frame period, and wherein the emission signal comprises only one sensor blackout pulse in each frame period.

7. The electronic device of claim 1, wherein the display has a refresh rate with a frame period, and wherein the emission signal comprises multiple sensor blackout pulses in each frame period.

8. The electronic device of claim 1, the display further comprising:

a first emission gate driver circuit configured to generate a first emission signal for a pixel outside of the sensor blackout region; and a second emission gate driver circuit configured to generate a second emission signal for a pixel in the sensor blackout region.

9. The electronic device of claim 8, wherein the first and second emission gate driver circuits are controlled using at least two separate start pulse signals.

10. The electronic device of claim 8, wherein the first and second emission gate driver circuits are controlled using only one start pulse signal.

11. The electronic device of claim 8, wherein the second emission gate driver circuit is further configured to receive an enable signal for asserting the sensor blackout pulse and a reset signal for deasserting the sensor blackout pulse.

12. An electronic device, comprising:

a display configured to operate at a refresh rate; and a sensor configured to receive light through the display, wherein the display comprises:

a first row of pixels controlled using a first pulse-width-modulated emission signal having first pulse-width-modulation (PWM) blanking pulses and having a pulse-width modulation blanking rate greater than the refresh rate;

a second row of pixels controlled using a second pulse-width-modulated emission signal having second pulse-width-modulation (PWM) blanking pulses, having the pulse-width modulation blanking rate, and having sensor blackout pulses with a sensor blackout pulse rate that is equal to or greater than the refresh rate and that prevents a portion of the display overlapping with the sensor from emitting light when the sensor is detecting light through the display.

13. The electronic device of claim 12, wherein the display further comprises:

a pixel uniformity compensation circuit configured to compensate for a luminance reduction in the second row of pixels due to the at least one sensor blackout pulse.

14. The electronic device of claim 13, wherein the pixel uniformity compensation circuit is configured to compensate for the luminance reduction by selectively boosting the luminance level during emission on times for the second row of pixels.

15. The electronic device of claim 13, wherein the pixel uniformity compensation circuit is configured to compensate for the luminance reduction by extending emission on times for the second row of pixels.

16. An electronic device, comprising:

a display; and a sensor configured to receive light through the display, wherein pixels in a region of the display overlapping with the sensor are prevented from emitting light while the sensor is detecting light through the display, wherein the display comprises:

a first group of emission gate drivers configured to output first periodic blanking pulses for controlling pixels outside of the region; and a second group of emission gate drivers configured to:

output second periodic blanking pulses for controlling the pixels in the region using first and second clock signals;

assert a sensor blackout pulse that is between two successive blanking pulses in the second periodic blanking pulses and that prevents the pixels in the region from emitting light using an enable signal; and deassert the sensor blackout pulse using a reset signal.

17. The electronic device of claim 16, wherein the first group of emission gate drivers is configured to receive a first start pulse signal and wherein the second group of emission gate drivers is configured to receive a second start pulse signal separate from the first start pulse signal.

18. The electronic device of claim 16, wherein the first and second groups of emission gate drivers are controlled using only one start pulse signal.

19. The electronic device of claim 16, wherein the first group of emission gate drivers is configured to receive first and second start pulse signals and wherein the second group of emission gate drivers is configured to receive a third start pulse signal separate from the first and second start pulse signals.

* * * * *